US011295750B2

(12) United States Patent
Fischer et al.

(10) Patent No.: US 11,295,750 B2
(45) Date of Patent: Apr. 5, 2022

(54) APPARATUS AND METHOD FOR NOISE SHAPING USING SUBSPACE PROJECTIONS FOR LOW-RATE CODING OF SPEECH AND AUDIO

(71) Applicant: Fraunhofer-Gesellschaft zur Förderung der angewandten Forschung e.V., Munich (DE)

(72) Inventors: Johannes Fischer, Eggolsheim (DE); Tom Bäckström, Espoo (FI)

(73) Assignee: FRAUNHOFER-GESELLSCHAFT ZUR FÖRDERUNG DER ANGEWANDTEN FORSCHUNG E.V., Munich (DE)

( * ) Notice: Subject to any disclaimer, the term of this patent is extended or adjusted under 35 U.S.C. 154(b) by 0 days.

(21) Appl. No.: 16/170,151

(22) Filed: Oct. 25, 2018

(65) Prior Publication Data

US 2020/0105283 A1 Apr. 2, 2020

(30) Foreign Application Priority Data

Sep. 27, 2018 (EP) ..... 18197377

(51) Int. Cl.
*G10L 19/032* (2013.01)
*G10L 19/02* (2013.01)

(52) U.S. Cl.
CPC ..... *G10L 19/0212* (2013.01); *G10L 19/032* (2013.01)

(58) Field of Classification Search
CPC ..... G10L 19/0212; G10L 19/032
See application file for complete search history.

(56) References Cited

U.S. PATENT DOCUMENTS 6,636,830 B1 10/2003 Princen et al.
8,463,604 B2 * 6/2013 Vos ..... G10L 19/04 704/230
2004/0170290 A1 * 9/2004 Chang ..... G10L 19/032 381/94.2
2010/0094637 A1 * 4/2010 Vinton ..... G10L 19/03 704/500
2011/0145003 A1 6/2011 Bessette
2011/0270616 A1 * 11/2011 Garudadri ..... G10L 19/02 704/500

OTHER PUBLICATIONS

"Noise Shaping", Wikipedia, [online], https://en.wikipedia.org/wiki/Noise_shaping; retrieved from "www.archive.org", archived on Mar. 30, 2017. (Year: 2017).*

(Continued)

*Primary Examiner* — Jialong He
(74) *Attorney, Agent, or Firm* — McClure, Qualey & Rodack, LLP

(57) ABSTRACT

An apparatus for encoding an audio input signal to obtain an encoded audio signal is provided. The apparatus comprises a transformation module configured to transform the audio input signal from an original domain to a transform domain to obtain a transformed audio signal. Moreover, the apparatus comprises an encoding module, configured to quantize the transformed audio signal to obtain a quantized signal, and configured to encode the quantized signal to obtain the encoded audio signal. The transformation module is configured to transform the audio input signal depending on a plurality of predefined power values of quantization noise in the original domain.

24 Claims, 4 Drawing Sheets

(56) References Cited

OTHER PUBLICATIONS

Backstrom, Tom, and Johannes Fischer. "Coding of parametric models with randomized quantization in a distributed speech and audio codec." Speech Communication; 12. ITG Symposium. VDE, 2016. (Year: 2016).*

TS 26.445, EVS Codec Detailed Algorithmic Description; 3GPP Technical Specification (Release 12), 3GPP, 2014.

ISO/IEC 23003-3:2012, "MPEG-D (MPEG audio technologies), Part 3: Unified speech and audio coding," 2012.

B. Edler, "Coding of audio signals with overlapping block transform and adaptive window functions," Frequenz, vol. 43, No. 9, pp. 252-256, 1989.

T. Bäckström and C. R. Helmrich, "Arithmetic coding of speech and audio spectra using TCX based on linear predictive spectral envelopes," in Proc. ICASSP, Apr. 2015, pp. 5127-5131.

T. Bäckström, J. Fischer, and S. Das, "Dithered quantization for frequency-domain speech and audio coding," in Proc. Interspeech, 2018.

T. Bäckström and J. Fischer, "Fast randomization for distributed low-bitrate coding of speech and audio," IEEE/ACM Trans. Audio, Speech, Lang. Process., vol. 26, No. 1, Jan. 2018.

T. Bäckström, F. Ghido, and J. Fischer, "Blind recovery of perceptual models in distributed speech and audio coding," in Proc. Interspeech, 2016, pp. 2483-2487.

J.-M. Valin, G. Maxwell, T. B. Terriberry, and K. Vos, "High-quality, low-delay music coding in the OPUS codec," in Audio Engineering Society Convention 135. Audio Engineering Society, 2013.

J. Vanderkooy and S. P. Lipshitz, "Dither in digital audio," Journal of the Audio Engineering Society, vol. 35, No. 12, pp. 966-975, 1987.

F. C. Leone, L. S. Nelson, and R. B. Nottingham, "The folded normal distribution," Technometrics, vol. 3, No. 4, pp. 543-550, 1961.

* cited by examiner

APPARATUS AND METHOD FOR NOISE SHAPING USING SUBSPACE PROJECTIONS FOR LOW-RATE CODING OF SPEECH AND AUDIO

The present invention relates to audio signal encoding, audio signal processing and audio signal decoding, and, in particular, to an apparatus and a method for noise shaping using subspace projections for low-rate coding of speech and audio.

In coding speech at low bit-rates, codecs based on the code excited linear prediction (CELP) paradigm are predominant [1]. These codecs model the spectral envelope using linear predictive coding and the fundamental frequency using long-term prediction. The residual is typically encoded in the time domain using vector codebooks. The main weakness of such codecs is their computational complexity, due to the analysis-by-synthesis loop, which is used for optimizing the perceptual quality of the output.

Motivated by a desire to reduce computational complexity, as well as with the aim of unifying speech and audio coding, recently the trend has shifted towards coding in the frequency domain. Modern speech coding algorithms use frequency domain coding to encode the speech signal with low computational complexity.

To minimize the perceived degradation of the speech signal, they shape the quantization noise using a perceptual model. State-of-the-art codecs further apply uniform quantization and arithmetic coding in a rate-loop to efficiently transmit the signal spectra. For higher bit-rates, this approach offers near-optimal SNR and a high perceptual quality. However, at lower bitrates, the quantization noise is highly correlated to the original signal as parts of the spectrum with low energy are quantized to zero. As a consequence, the decoded (audio) signals often sound muffled.

Modern coders like 3rd Generation Partnership Project (3GPP) Enhanced Voice Service (EVS) and Moving Picture Experts Group (MPEG)-D unified speech and audio coding (USAC) [2], [3] encode the signal using the modified discrete cosine transform (MDCT) [4], [5], where quantization and coding is shaped by an envelope model [6].

This approach avoids the analysis-by-synthesis loop and thus allows coding at a low computational complexity. The magnitude of the quantization noise is shaped by a perceptual model, approximating the auditory masking threshold, such that the perceptual effect of the quantization noise is minimized.

Such codecs use an arithmetic coder which requires a rate-loop such that accuracy is scaled to the available bit-rate, which increases the required computational power significantly, and which is a drawback considering the resource constraints on typical platforms such as mobile phones.

Moreover, the arithmetic coder with uniform quantization at a low bitrate tends to correlate the quantization noise to the original speech signal, whereas it offers near-optimal performance for high bit-rates. This correlation yields an encoded (audio) signal that tends to sound muffled, as higher frequencies are often quantized to zero. Moreover, coding efficiency is reduced with decreasing bit-rates.

Different approaches have been presented to counteract the band limited nature of the encoded speech signal. One paradigm would be bandwidth extension methods, where the spectral magnitudes of higher frequencies are estimated either using side-info or blindly from the lower parts of the spectrum [1]. Thus, only the lower frequency regions of the speech signal are encoded explicitly. Another approach is to counteract the muffled sound of encoded speech by applying noisefilling, which adds artificial noise to the holes in the higher frequencies or by applying dithering [7], [8], [9], [10], [11].

The object of the present invention is to provide improved concepts for audio signal encoding, audio signal processing and audio signal decoding. The object of the present invention is solved by an apparatus according to claim 1, by an apparatus according to claim 11, by a method according to claim 23, by a method according to claim 24, and by a computer program according to claim 25.

An apparatus for encoding an audio input signal to obtain an encoded audio signal is provided. The apparatus comprises a transformation module configured to transform the audio input signal from an original domain to a transform domain to obtain a transformed audio signal. Moreover, the apparatus comprises an encoding module, configured to quantize the transformed audio signal to obtain a quantized signal, and configured to encode the quantized signal to obtain the encoded audio signal. The transformation module is configured to transform the audio input signal depending on a plurality of predefined power values of quantization noise in the original domain.

Furthermore, an apparatus for decoding an encoded audio signal to obtain a decoded audio signal is provided. The apparatus comprises a decoding module, configured to decode the encoded audio signal to obtain a quantized signal, and configured to dequantize the quantized signal to obtain an intermediate signal, being represented in a transform domain. Moreover, the apparatus comprises a transformation module configured to transform the intermediate signal from the transform domain to an original domain to obtain the decoded audio signal. The transformation module is configured to transform the intermediate signal depending on a plurality of predefined power values of quantization noise in the original domain.

Moreover, a method for encoding an audio input signal to obtain an encoded audio signal is provided. The method comprises:

- Transforming the audio input signal from an original domain to a transform domain to obtain a transformed audio signal.
- Quantizing the transformed audio signal to obtain a quantized signal. And:
- Encoding the quantized signal to obtain the encoded audio signal.

Transforming the audio input signal is conducted depending on a plurality of predefined power values of quantization noise in the original domain.

Furthermore, a method for decoding an encoded audio signal to obtain a decoded audio signal is provided. The method comprises:

- Decoding the encoded audio signal to obtain a quantized signal.
- Dequantizing the quantized signal to obtain an intermediate signal, being represented in a transform domain.
- Transforming the intermediate signal from the transform domain to an original domain to obtain the decoded audio signal.

Transforming the intermediate signal is conducted depending on a plurality of predefined power values of quantization noise in the original domain.

Moreover, a non-transitory computer-readable medium comprising a computer program for implementing the method for encoding when being executed on a computer or signal processor is provided.

In contrast to the state-of-the art, embodiments employ uniform quantization in a sub-space, where the quantization noise can be shaped by choice of the subspace projection. For components exceeding one bit/sample, these transforms are complemented either by an iterative delta-coding scheme or by applying arithmetic coding.

Embodiments provide a modification of dithered quantization and coding approach, combined with a differential one bit quantization scheme that offers computationally efficient coding also with constant bit-rates. Due to dithering, the resulting quantization reduces the correlation between quantization noise and the original speech signal and can be shaped according to a perceptual model. Thus, the quantized signal does not lack energy in the higher frequencies and will not sound muffled. Since perceptual quantization noise would then be perceivable at low-energy parts of the spectrum, such as the high-frequencies, one may, e.g., further incorporate Wiener filtering in the decoder to best recover the original signal.

Experiments show that the proposed coder gives a better signal-to-noise ratio (SNR) than conventional uniform quantization with arithmetic coding at low bit-rates and that the coder according to embodiments is very close to optimal coding efficiency. In particular, experiments show that when only iterative one-bit coding is employed, the perceptual SNR is only improved for lower bit-rates. However, the hybrid approach according to embodiments which combines the proposed sub-space transforms with arithmetic coding improves both SNR and perceptual quality for lower bit-rates and converges to the performance of the arithmetic coder at higher bit-rates.

Some embodiments provide a sub space transform, that allows to determine the power spectral density (PSD) of the quantization noise in order to minimize the perceptual degradation.

This subspace transform is applicable, if the required accuracy of each sample is smaller than one bit. Thus, in practice it may, for example, be complemented by a second quantization scheme.

In order to stay in the paradigm of one bit quantization, a combination of the provided subspace transform and a differential one-bit quantization approach may, e.g., be implemented.

Such embodiments iteratively quantize the error of the previous quantization step.

Moreover, in some embodiments, a combination of arithmetic coding and the sub-space transform is provided. In the evaluation the two of the new embodiments are compared to classic arithmetic coding and to a hybrid coder.

In the evaluation some of the embodiments are compared with state-of-the-art methods in a simplified TCX-type coding scenario. The objective evaluation showed that the performance of the provided embodiments of arithmetic coding and the sub-space transform exceeds the performance of the other tested approaches in terms of SNR. The differential approach works particularly well for lower bit-rates. The MUSHRA listening test confirms that the results of the objective evaluation.

Embodiments provide a hybrid coding scheme which exceeds the performance of state-of-the-art encoding schemes both in the objective and in the subjective evaluation. Moreover, the provided embodiments can be readily used in any TCX-like speech coder.

In the following, embodiments of the present invention are described in more detail with reference to the figures, in which.

Figure 1:
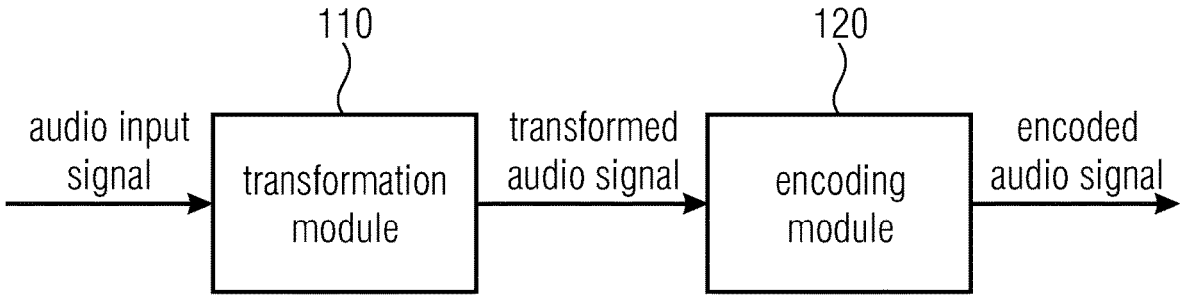
FIG. 1 illustrates an apparatus for encoding according to an embodiment.

FIG. 1 illustrates an apparatus for encoding an audio input signal to obtain an encoded audio signal according to an embodiment. The apparatus comprises a transformation module 110 configured to transform the audio input signal from an original domain to a transform domain to obtain a transformed audio signal. Moreover, the apparatus comprises an encoding module 120, configured to quantize the transformed audio signal to obtain a quantized signal, and configured to encode the quantized signal to obtain the encoded audio signal. The transformation module 110 is configured to transform the audio input signal depending on a plurality of predefined power values of quantization noise in the original domain.

According to an embodiment, the transformation module 110 may, e.g., be configured to transform the audio input signal from the original domain to the transform domain by conducting an orthogonal transformation.

In an embodiment, the original domain may, e.g., be a spectral domain.

According to an embodiment, the transformation module 110 may, e.g., be configured to transform the audio input signal depending on the plurality of predefined power values of quantization noise in the original domain and depending on a plurality of predefined power values of the quantization noise in the transform domain.

In an embodiment, the transformation module 110 may, e.g., be configured to transform the audio input signal using a transformation matrix A, wherein the transformation module 110 is configured to transform the audio input signal according to:

$$d=Ax,$$

wherein d indicates the transformed audio signal, wherein x indicates the audio input signal, wherein A indicates the transformation matrix depending on the plurality of predefined power values of the quantization noise in the original domain and depending on the plurality of predefined power values of the quantization noise in the transform domain.

According to an embodiment, A may, e.g., be defined according to $$A = \begin{bmatrix} p & -\sqrt{1-p^2} \\ +\sqrt{1-p^2} & p \end{bmatrix},$$

wherein p may, e.g., be defined according to:

$$p = \pm\sqrt{\frac{d_0 - c1}{c_0 - c_1}},$$

wherein

-continued $$C_{ex} = \begin{bmatrix} d_0 & \cdot \\ \cdot & d_1 \end{bmatrix},$$

wherein $$C_{ed} = \begin{bmatrix} c_0 & 0 \\ 0 & c_1 \end{bmatrix},$$

wherein $C_{ex}$ is a first covariance matrix comprising on its diagonal the plurality of predefined power values of the quantization noise in the original domain, wherein $d_0$ and $d_1$ are matrix coefficients of $C_{ex}$, and wherein $C_{ed}$ is a second covariance matrix comprising on its diagonal the plurality of predefined power values of the quantization noise in the transform domain, wherein $c_0$ and $c_1$ are matrix coefficients of $C_{ed}$.

In an embodiment, the transform module may, e.g., be configured to determine the matrix A by determining two or more rotations depending on the plurality of predefined power values of quantization noise in the original domain and depending on the plurality of predefined power values of the quantization noise in the transform domain.

According to an embodiment, the transformation module 110 may, e.g., be configured to transform the audio input signal depending on a variance of the quantization noise in the transform domain.

In an embodiment, the variance $\sigma_q^2$ of the quantization noise in the transform domain may, e.g., be defined according to $$\sigma_q^2 = \sigma_\xi^2\left(1 - \frac{2}{\pi}\right),$$

wherein $\sigma_\xi^2$ is a variance of sign quantization of a sample $\xi$ of the transformed audio signal in the transform domain, wherein the transformation module 110 is configured to transform the audio input signal depending on $C_{ed}$ that comprises on its diagonal the plurality of predefined power values of the quantization noise in the transform domain, wherein $C_{ed}$ may, e.g., be defined according to:

$$C_{ed} = \begin{bmatrix} \sigma_q^2 I_B & 0 \\ 0 & \sigma_\xi^2 I_{N-B} \end{bmatrix},$$

wherein N Indicates a number of samples of the transformed audio signal, wherein B indicates a number of bits of the quantized signal, wherein $I_B$ indicates an identity matrix having B rows and B columns, and wherein $I_{N-B}$ indicates an identity matrix having N-B rows and N-B columns.

According to an embodiment, the transformation module 110 may, e.g., be configured to conduct permutations on samples of the audio input signal before transforming the audio input signal to the transform domain.

Likewise, decoding may, e.g., be conducted on a decoder side by applying the same or analogous principles as applied for encoding on an encoder side. To this end, an apparatus for decoding may conduct decoding based on the same assumptions as the assumptions of an apparatus for encoding on the encoder side.

For example, an apparatus for encoding and an apparatus for decoding may, e.g., use a same plurality of predefined power values of quantization noise in the original domain and may, e.g., use a same plurality of predefined power values of the quantization noise in the transform domain. This may, e.g., be achieved by having same, similar or analogous start values and algorithms implemented in the apparatus for encoding and in the apparatus for decoding.

Figure 2:
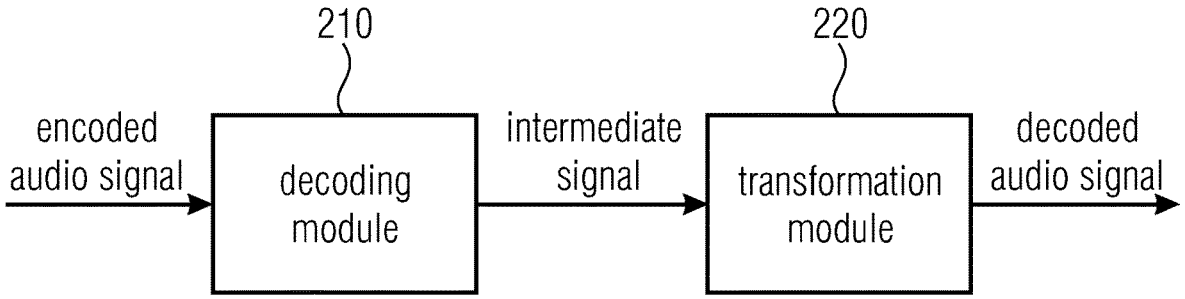
FIG. 2 illustrates an apparatus for decoding according to an embodiment.

FIG. 2 illustrates an apparatus for decoding an encoded audio signal to obtain a decoded audio signal according to an embodiment. The apparatus comprises a decoding module 210, configured to decode the encoded audio signal to obtain a quantized signal, and configured to dequantize the quantized signal to obtain an intermediate signal, being represented in a transform domain. Moreover, the apparatus comprises a transformation module 220 configured to transform the intermediate signal from the transform domain to an original domain to obtain the decoded audio signal. The transformation module 220 is configured to transform the intermediate signal depending on a plurality of predefined power values of quantization noise in the original domain.

According to an embodiment, the transformation module 220 may, e.g., be configured to transform the intermediate signal from the transform domain to the original domain by conducting an orthogonal transformation.

In an embodiment, the original domain may, e.g., be a spectral domain.

According to an embodiment, the transformation module 220 may, e.g., be configured to transform the intermediate signal depending on the plurality of predefined power values of quantization noise in the original domain and depending on a plurality of predefined power values of the quantization noise in the transform domain.

In an embodiment, the transformation module 220 may, e.g., be configured to transform the intermediate signal using a transformation matrix $A^T$, wherein the transformation module 220 is configured to transform the audio input signal according to:

$$x = A^T d,$$

wherein d indicates the intermediate signal, wherein x indicates the decoded audio signal, wherein $A^T$ indicates the transformation matrix depending on the plurality of predefined power values of the quantization noise in the original domain and depending on the plurality of predefined power values of the quantization noise in the transform domain.

According to an embodiment, $A^T$ may, e.g., be a conjugate transpose matrix of a matrix A, wherein the matrix A may, e.g., be defined according to:

$$A = \begin{bmatrix} p & -\sqrt{1-p^2} \\ +\sqrt{1-p^2} & p \end{bmatrix},$$

wherein p may, e.g., be defined according to:

$$p = \pm\sqrt{\frac{d_0 - c1}{c_0 - c_1}},$$

wherein $$C_{ex} = \begin{bmatrix} d_0 & \cdot \\ \cdot & d_1 \end{bmatrix},$$

-continued wherein $$C_{ed} = \begin{bmatrix} c_0 & 0 \\ 0 & c_1 \end{bmatrix},$$

wherein $C_{ex}$ may, e.g., be a first covariance matrix comprising on its diagonal the plurality of predefined power values of the quantization noise in the original domain, wherein $d_0$ and $d_1$ are matrix coefficients of $C_{ex}$, and wherein $C_{ed}$ may, e.g., be a second covariance matrix comprising on its diagonal the plurality of predefined power values of the quantization noise in the transform domain, wherein $c_0$ and $c_1$ are matrix coefficients of $C_{ed}$.

In an embodiment, the transform module may, e.g., be configured to determine matrix $A^T$ by determining two or more rotations depending on the plurality of predefined power values of quantization noise in the original domain and depending on the plurality of predefined power values of the quantization noise in the transform domain.

According to an embodiment, the transformation module 220 may, e.g., be configured to transform the intermediate signal depending on a variance of the quantization noise in the transform domain.

In an embodiment, the variance $\sigma_q^2$ of the quantization noise in the transform domain is defined according to $$\sigma_q^2 = \sigma_\xi^2\left(1 - \frac{2}{\pi}\right),$$

wherein $\sigma_\xi^2$ is a variance of sign quantization of a sample $\xi$ of the quantized signal in the transform domain, wherein the transformation module 220 may, e.g., be configured to transform the intermediate signal depending $C_{ed}$ that comprises on its diagonal the plurality of predefined power values of the quantization noise in the transform domain, wherein $C_{ed}$ may, e.g., be defined according to:

$$C_{ed} = \begin{bmatrix} \sigma_q^2 I_B & 0 \\ 0 & \sigma_\xi^2 I_{N-B} \end{bmatrix},$$

wherein N Indicates a number of samples of the intermediate audio signal, wherein B indicates a number of bits of the quantized signal, wherein $I_B$ indicates an identity matrix having B rows and B columns, and wherein $I_{N-B}$ indicates an identity matrix having N-B rows and N-B columns.

According to an embodiment, the transformation module 220 may, e.g., be configured to conduct permutations on samples of the audio input signal after transforming the intermediate signal to the original domain to obtain the decoded audio signal.

In an embodiment, considering an apparatus for decoding an encoded audio signal to obtain a decoded audio signal according to one of the above-described embodiments, the encoded audio signal may, e.g., be encoded by an apparatus for encoding according to one of the above-described embodiments.

Figure 3:
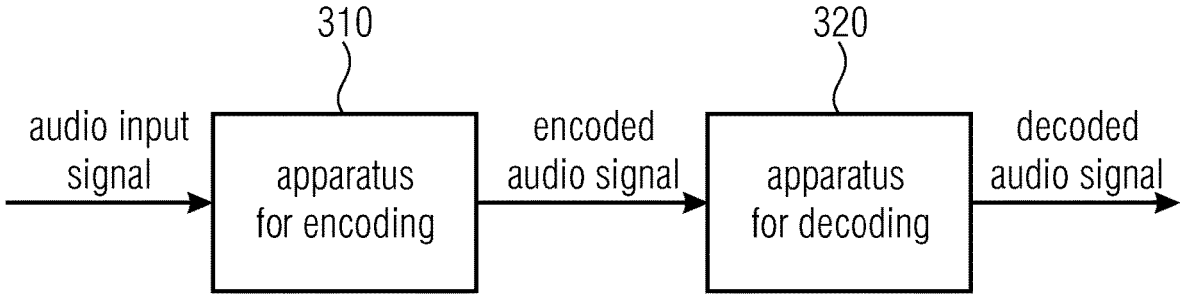
FIG. 3 illustrates a system according to an embodiment.

FIG. 3 illustrates a system according to an embodiment. The system comprises an apparatus 310 for encoding an audio input signal to obtain an encoded audio signal according to one of the above-described embodiments. Moreover, the system comprises an apparatus 320 for decoding the encoded audio signal to obtain a decoded audio signal according to one of the above-described embodiments. The apparatus for decoding 320 is configured to receive the encoded audio signal from the apparatus 310 for encoding.

Furthermore, a non-transitory computer-readable medium comprising a computer program for implementing the method for decoding when being executed on a computer or signal processor is provided.

In the following, embodiments are considered that relate to subspace projections.

In speech coding at low bit-rates, it is a common to encode the signal components with less than 1 bit/sample. In addition, in perceptual coding of speech and audio, the quantization noise should be shaped according to a psychoacoustic model, to minimize the perceptual degradation due to quantization.

Thus, a quantization scheme may, e.g., be employed which simultaneously allows both perceptual shaping of quantization noise and coding at less than 1 bit/sample.

The proposed approach has the following parts; In the first-pass, an orthogonal transform and quantization on a subspace is applied. The transform is designed such that quantization of the given sub-space yields quantization noise with the predefined spectral shape in the original domain. Then, an inverse transform is applied on the quantized signal. In the following iterations, the residual error of the previous iterations is quantized with the same approach, until all bits have been used.

An input vector is considered in the frequency domain $x \in \mathbb{R}^{N\times 1}$, (x may, e.g., be considered as audio input signal), which shall be encoded with B bits. Moreover, the power spectral density of the quantization noise should follow the shape of a given perceptual envelope $w \in \mathbb{R}^{N\times 1}$ in order to minimize the perceived degradation of the signal due to quantization. Let the transformed (audio) signal d be $$d = Ax, \tag{1}$$

and quantize it as $$\hat{d} = Q[d] = Q[Ax], \tag{2}$$

where Q[•] is the quantization operation and $\hat{d}$ the quantized signal. Since A is orthogonal, its transpose is its inverse such that the inverse transform follows:

$$\hat{x} = A^T\hat{d}. \tag{3}$$

The quantization error is then $e_d = d - \hat{d}$ and the output error is $e_x = x - \hat{x} = A^T e_d$. Thus, one defines two covariance matrices $C_{ed} = E[e_d e_d^T]$ and $C_{ex} = E[e_x e_x^T]$, which describe the error covariance (e.g., the covariance of the quantization noise) in the transform and in the original domain, where $(\bullet)^T$ denotes the conjugate transpose. One is only interested in the diagonals of these matrices and it is defined:

$$C_{ex} = \begin{bmatrix} c_0 & & \cdot \\ & \ddots & \\ \cdot & & c_{N-1} \end{bmatrix} \tag{4}$$

$$C_{ed} = \begin{bmatrix} d_0 & & \cdot \\ & \ddots & \\ \cdot & & d_{N-1} \end{bmatrix}$$

where $C_{ex} = \in \mathbb{R}^{N\times N}$ and $C_{ed} = \in \mathbb{R}^{N\times N}$, as the quantization space is a subspace of the original.

It should be noted that only the diagonal of the covariance matrices have been specified, in contrast to the off-axis entries corresponding to cross-correlations. Conversely, it is acknowledged that cross-correlations will be non-zero by design, when quantizing with less than 1 bit per sample.

A shall be designed such that the diagonal of the output error covariance $C_{ex}$ retains the predefined shape when the quantization error $C_{ed}$ is known. To derive such a transform matrix A, let us start with the simplest example where the input signal is of length N=2.

In a two dimensional space, all orthogonal matrices can be described (up to changes in sign) by $$A = \begin{bmatrix} p & -\sqrt{1-p^2} \\ +\sqrt{1-p^2} & p \end{bmatrix}. \tag{5}$$

Assuming that the quantization noise is uncorrelated, the two dimensional covariance matrix $C_{ed}$ is defined as $$C_{ed} = \begin{bmatrix} c_0 & 0 \\ 0 & c_1 \end{bmatrix}. \tag{6}$$

The matrix coefficients on the diagonal of $C_{ed}$ may, e.g., be considered as the plurality of predefined power values of quantization noise in the transform domain. The predefined power values of quantization noise in the transform domain may, e.g., be given by a quantization scheme or may, e.g., be estimated from the quantization scheme, wherein the quantization scheme itself may, e.g., be predefined.

The covariance of the error in the original domain can then readily be obtained by $C_{ex}=A^T C_{ed} A$:

$$C_{ex} = \begin{bmatrix} c_0 p^2 + c_1(1-p^2) & (c_1 - c_0)p\sqrt{1-p^2} \\ (c_1 - c_0)p\sqrt{1-p^2} & +c_0(1-p^2) + c_1 p^2 \end{bmatrix}. \tag{7}$$

Let the predefined correlation/predefined covariance of the quantization noise in the original domain be $$C_{ex} = \begin{bmatrix} d_0 & \cdot \\ \cdot & d_1 \end{bmatrix}, \tag{8}$$

where samples marked with a dot are not defined. The matrix coefficients on the diagonal of $C_{ex}$ may, e.g., be considered as the plurality of predefined power values of quantization noise in the original domain. From Equation 7 it then follows that $$\begin{cases} d_0 = c_0 p^2 + c_1(1-p^2) \\ d_1 = +c_0(1-p^2) + c_1 p^2 \end{cases} \tag{9}$$

and one can readily derive the predefined value of p as $$p = \pm\sqrt{\frac{d_0 - c1}{c_0 - c_1}}. \tag{10}$$

It shall be noted that $c_0+c_1=d_0+d_1$, that is, the error energy is retained through the transform.

In the following, a predefined correlation or a predefined covariance may, e.g., also be referred to as a target correlation or as a target covariance.

The following task may, e.g., be considered to determine the error covariance $C_{ed}$ of the quantizer. If sign quantization is applied on a sample ξ, which follows a zero-mean Gaussian distribution with variance $\sigma_\xi^2$, then its absolute value follows the half-normal distribution with mean $$\sigma_\xi\sqrt{\frac{2}{\pi}}$$

and variance $$\sigma_\xi^2\left(1-\frac{2}{\pi}\right)$$

[12]. The optimal scaling of sign quantization is thus $$\hat{\xi} = Q[\xi] = \sigma_\xi\sqrt{\frac{2}{\pi}}\,\mathrm{sign}(\xi)$$

and the variance of the error $\epsilon=\xi-\hat{\xi}$ is $$\sigma_q^2 = \sigma_\xi^2\left(1-\frac{2}{\pi}\right)$$

If the first sample is then quantized with this sign-quantizer and the second sample is put to zero, the covariance of the error would follow by $$C_{ed} = \begin{bmatrix} \sigma_q^2 & 0 \\ 0 & \sigma_\xi^2 \end{bmatrix} = \sigma_\xi^2\begin{bmatrix} 1-\frac{2}{\pi} & 0 \\ 0 & 1 \end{bmatrix}. \tag{11}$$

In other words, the sign quantizer reduces output error energy with a factor of $$\frac{2}{\pi}.$$

Applying scalar one-bit (sign) quantization in the transform domain, the error covariance in the original domain after the inverse transform follows by:

$$C_{ex}=A^T C_{ed} A. \tag{12}$$

For input vectors x of arbitrary length N, the approach is extended as follows. If the number of available bits is B, then the error correlation is defined as $$C_{ed} = \begin{bmatrix} \sigma_q^2 I_B & 0 \\ 0 & \sigma_\xi^2 I_{N-B} \end{bmatrix} = \mathrm{diag}(c_k), \tag{13}$$

where $I_K$ is the identity matrix of size K×K and the $c_k$'s are scalars. The definition of $C_{ed}$ in Equation 13 shows the covariance of the quantization error in the transform domain, where the first B-bits are quantized applying one bit quantization and the rest get quantized to zero.

Further let the diagonal of the target output covariance be $C_{ex}=\mathrm{diag}(d_k)$. This diagonal specifies the power spectral density of the quantization noise in the original domain, thus the quantization noise is shaped according to perceptual measure, in order to have minimal impact on the perceived degradation.

The preceding derivation is limited to vectors of length two. In order to generalize this scheme to arbitrary length, such that it is applicable in practice, it is considered to apply multiple rotation in sequence.

A sequence of Givens rotations $G\in\mathbb{R}^{N\times N}$, defined in matrix formulation as $\mathbb{R}$ $$G=\begin{bmatrix} 1 & \dots & 0 & \dots & 0 & \dots & 0 \\ \vdots & \ddots & \vdots & & \vdots & & \vdots \\ 0 & \dots & p & \dots & -\sqrt{1-p^2} & \dots & 0 \\ \vdots & & \vdots & \ddots & \vdots & & \vdots \\ 0 & \dots & +\sqrt{1-p^2} & \dots & p & \dots & 0 \\ \vdots & & \vdots & & \vdots & \ddots & \vdots \\ 0 & \dots & 0 & \dots & 0 & \dots & 1 \end{bmatrix}$$

are applied on $C_{ed}$ by matrix multiplication to move error energy to match the target $C_{ex}$, wherein the choice of p is determined by Eq. 10. The same sequence of rotations will be applied on a matrix $A\in\mathbb{R}^{N\times N}$, initialized by an identity matrix of size N×N, which yields the desired transform matrix.

It should be noted that for the following description, the diagonal entries of $C_{ex}$ should be sorted by ascending order.

It is assumed that one has correct output error energies $d_k$ below a sample index k and that the next available position from where one can move energy in the input error $c_h$ is at index h. Due to the given ascending order the input error energy is larger than the output, $c_k\geq d_k$, whereby Equation 10 can be used to obtain the predefined amount of output error energy $d_k$ and one can then increment k:=k+1.

This can also be formulated in an algorithm:

```
for k = 1 : N − 1 do
  h = 1
  while d_{k+h} < c_k do
    h = h + 1
  Apply rotation
```

In other words, in a sequence of pair-wise rotations, the input error energy can be rotated such that the predefined output error energy distribution is obtained. For additional dithering, if predefined, one can also apply random permutations on x before multiplication with A, following [8].

The above algorithm is applicable when 1) the sum of the predefined output error energy exactly matches the sum of the input error energy $\Sigma_k\ c_k=\Sigma_k\ d_k$ and 2) output error energies are in the convex hull of the input energies $\min_h d_k\leq c_h\leq\max_h d_k$. 3) the entries of the diagonal of $C_{ex}$ need to be presorted in ascending order.

In the following, embodiments are considered that relate to an iterative one-bit approach.

The above introduced sub-space projection approach yields optimal performance if each sample has to be encoded with an accuracy less than one-bit. Thus this approach may, e.g., be complemented by a scheme capable to encode samples with a higher accuracy than one-bit. As the approach shall also be based on one-bit quantization, a differential version was implemented, where the error of the previous iteration is encoded with one bit. Iteration is conducted until the required accuracy is reached.

However, this scheme offers only sub-optimal performance, as after the iteration the distribution of the residual is not known anymore and the assumption that it follows a Gaussian distribution does not hold any more. Moreover, with each step the residual has to be rescaled to unit variance. This rescaling factor shall not be transmitted due to data rate limitations and shall therefore be estimated.

Figure 4:
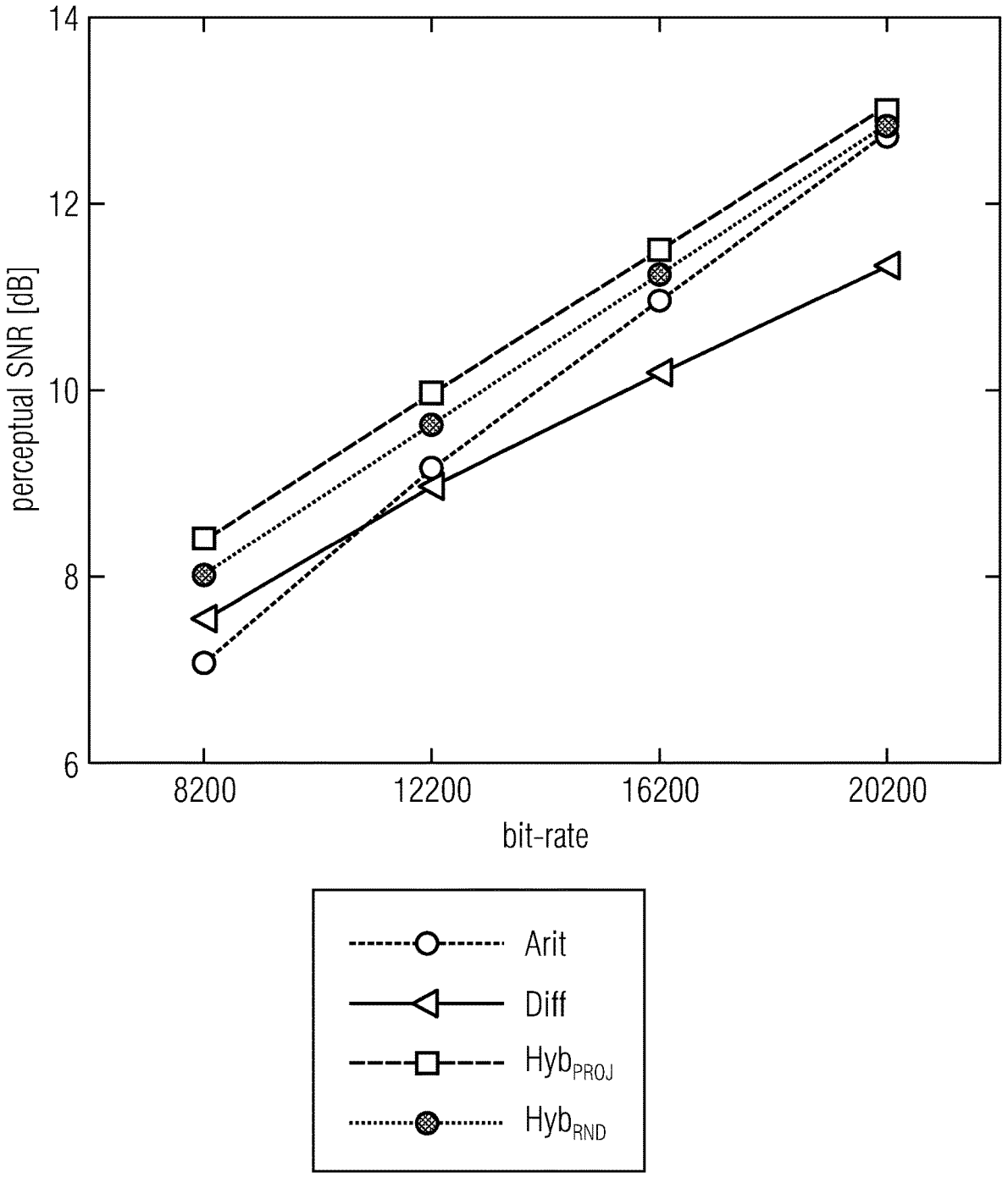
FIG. 4 illustrates a perceptual signal-to-noise ratio of embodiment compared to state-of-the-art, plotted as a function of the bit-rate.

FIG. 4 illustrates a perceptual signal-to-noise ratio of embodiment ($\mathrm{Hyb}_{PROJ}$) compared to state-of-the-art, plotted as a function of the bit-rate.

In the following, evaluation aspects are presented.

According to embodiments, sub-space transforms are applied in order to quantize samples with an accuracy lower than one bit. As this approach may, e.g., be supplemented to enable an accuracy higher than one bit per sample, it may, for example, be combined with either an arithmetic coder, and a differential one-bit quantizer. As a benchmark, it is also compared to sole arithmetic coding and to the recently introduced hybrid coder, applying randomized transforms. In order to compare the performance in a practical scenario, a transform coded excitation (TCX) transform coder is implemented based on the structure of the one implemented in EVS [2].

In this application the input signal is windowed and transformed to the frequency domain applying the MDCT. The frequency domain vectors are then whitened, applying the inverse of the spectral shape of a linear prediction (LP) filter that was calculated on the time domain input of the MDCT. These time-domain vectors are then normalized to yield vectors of unit variance. In order to minimize the perceptual degradation of the introduced quantization noise, the bit-distribution over the frequency domain residual was deduced from a perceptual model, also adopted from EVS [2], such that the resulting quantization noise follows the shape of the masking threshold.

As test items the american-english, items of the Nippon Telegraph and Telephone-Advanced Technology (NTT-AT) Multilingual Speech Database 2002 were used. As a sampling rate 12.8 kHz was chosen, resulting in a bandwidth of 6.4 kHz, also referred to as wide-band speech. The input signal was windowed applying a symmetric window of 30 ms length, that was constructed as a raised-cosine window of 20 ms, where a constant part of 10 ms was added. The step size was chosen to be 20 ms.

For the objective evaluation the different approaches with respect to their perceptual SNR were compared, as this is also the domain in which the quantization error is minimized and thus gives us a direct measure of performance of the individual approaches.

The results of the perceptual SNR are depicted in FIG. 4. For the lowest tested bit-rate, the hybrid approaches can improve the performance of the arithmetic coder. For this low bit-rate also the differential one-bit quantization is capable to achieve better results than the arithmetic coder. However, with increasing bit-rate the difference between the hybrid approaches and the arithmetic coder diminishes. This convergence can be easily explained by the fact that with increasing bit-rate, more bits are available, and thus the arithmetic coder will be used predominantly for the different approaches. Although the differential approach works particularly well for the lowest presented bit-rate. It becomes clear that the performance is sub-optimal, especially if the number of iterations increases.

To confirm that the results of the objective evaluation reflect the human perception, a MUSHRA test was performed, in which 14 subjects participated. As stimuli, two male (WA01M029 and WA01M050) and two female (WA01F007 and WA01F016) speech samples from the NTT-AT database were selected, which were quantized at a bit-rate of 8.2 kbit s−1 and 16.2 kbit s−1. The results of the listening tests are presented in FIG. 5 and FIG. 6 for 8.2 kbit $s^{-1}$ and 16.2 kbit $s^{-1}$ respectively.

Figure 5:
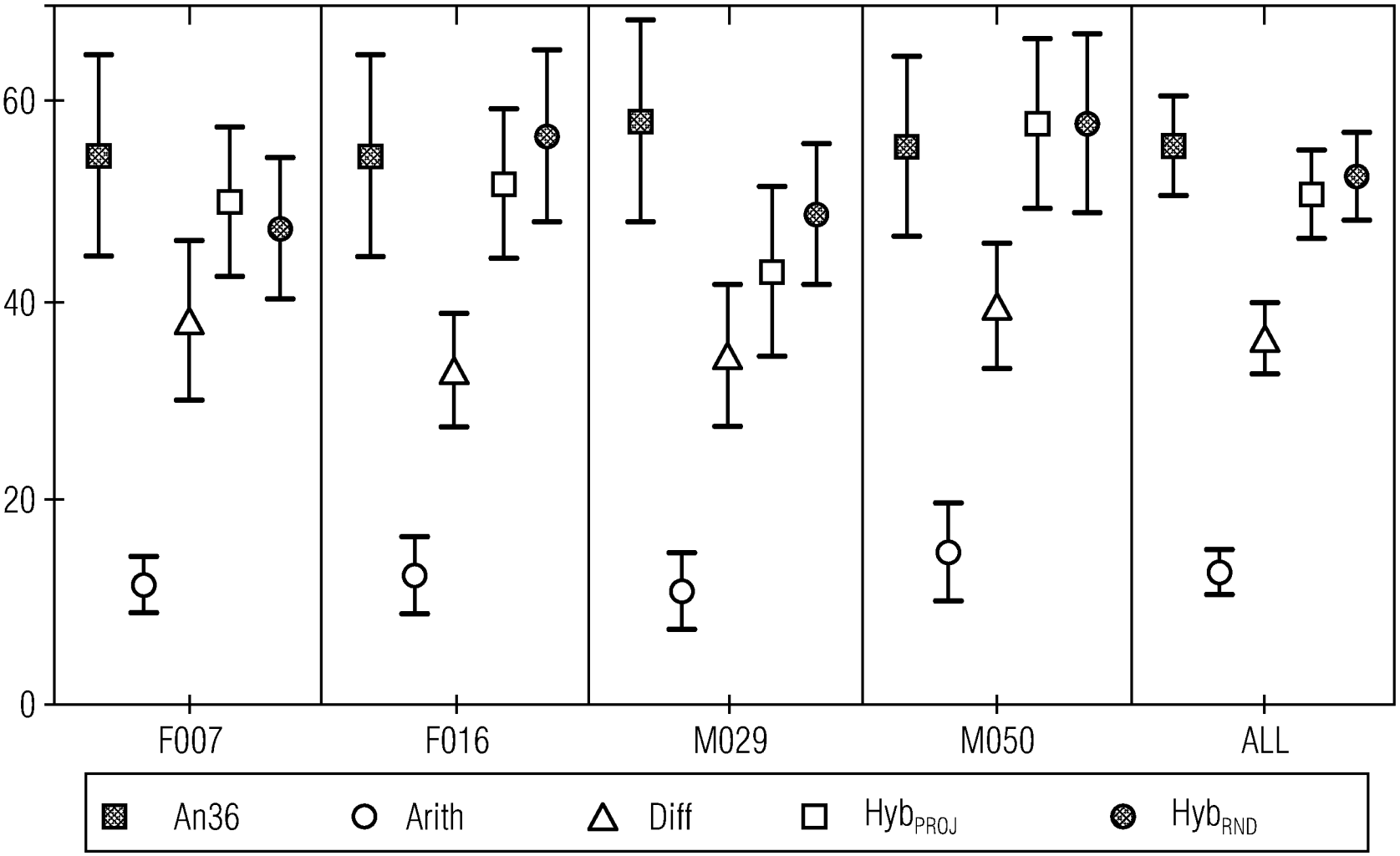
FIG. 5 illustrates results of the MUSHRA listening test where the residual was encoded using 8.2 kbit $s^{-1}$.

FIG. 5 illustrates results of the MUSHRA listening test where the residual was encoded using 8.2 kbit $s^{-1}$.

Figure 6:
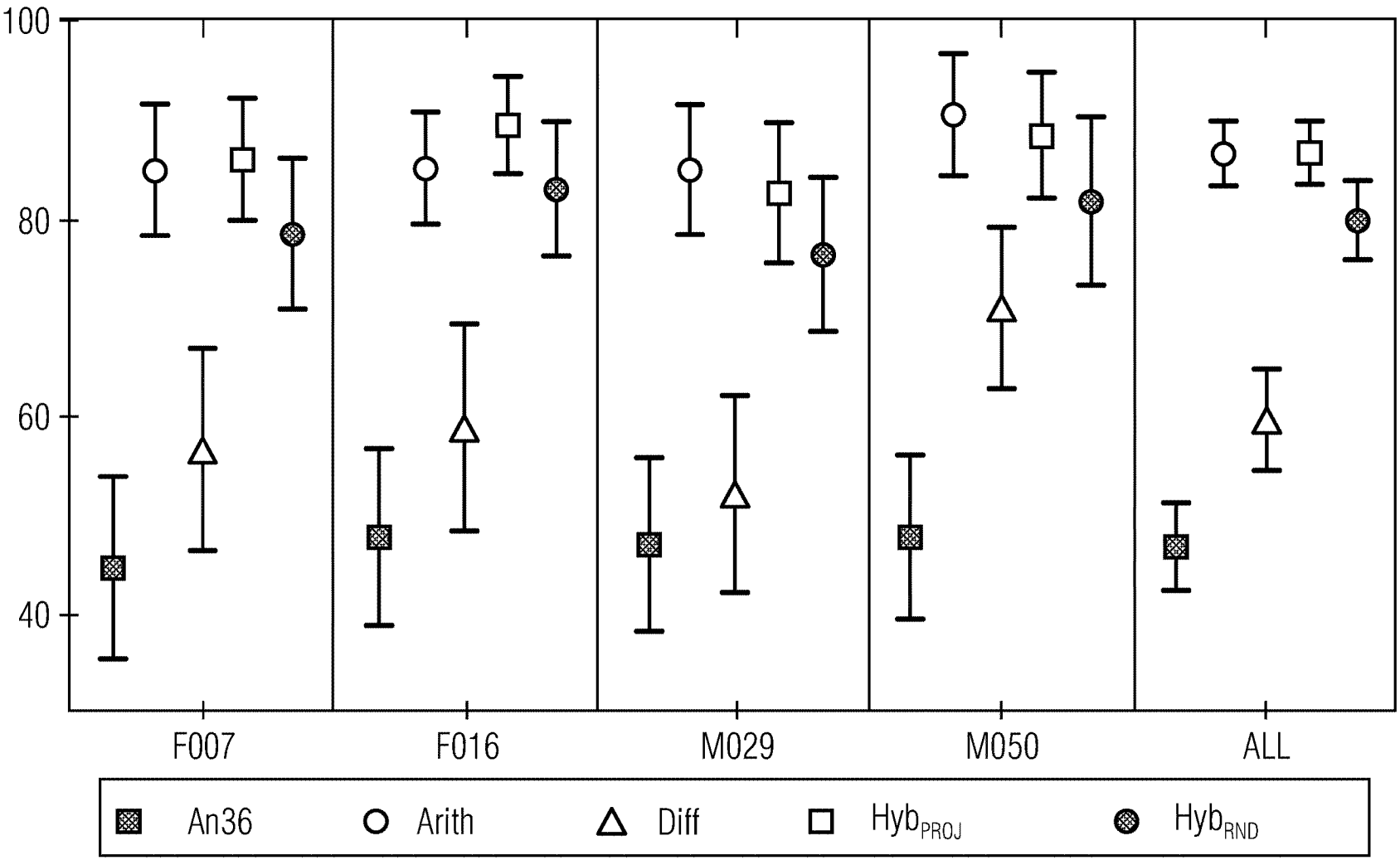
FIG. 6 illustrates results of the MUSHRA listening test running at 16.2 kbit $s^{-1}$.

FIG. 6 illustrates results of the MUSHRA listening test running at 16.2 kbit $s^{-1}$.

The results for the lower bit-rate of 8.2 kbit s−1 are depicted in FIG. 5 and reflect the results of the objective evaluation. Thus, all hybrid and the differential coding approaches perform significantly better than the arithmetic coding approach. However, there is no significant difference between the hybrid approaches and the differential, yet the mean score of the hybrid approaches are higher than the differential approach.

The results for the higher bit-rate of 16.2 kbit s−1, show no significant differences between the arithmetic and the hybrid coding approaches, the differential approach however shows a clear disadvantage in performance.

The fact that the perceptual difference of the hybrid approaches decreases with an increase in bit-rate can be easily explained. With an increase in bit-rate, the average bits spend per frequency bin will increase. Any bin that is encoded with an accuracy higher than one bit per bin will be encoded, applying the arithmetic coder. Thus with an increase in bit-rate the number of frequency bins that are encoded applying arithmetic coding will typically increase. Thus the performance of the different approaches will converge with increasing bit-rate.

As the application of the proposed encoding scheme is aimed at speech coding, speech samples were used for the formal evaluation. Informal evaluation however showed that for signals that are very sparse in the frequency domain, the arithmetic coding has a small advantage also at lower bit-rates.

Such signals could be of synthetic nature as pure sinusoids or very harmonic signals with a small number of harmonics, e.g. pitch-pipes. For other music signals however, the results of this evaluation are transferable.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus. Some or all of the method steps may be executed by (or using) a hardware apparatus, like for example, a microprocessor, a programmable computer or an electronic circuit. In some embodiments, one or more of the most important method steps may be executed by such an apparatus.

Depending on certain implementation requirements, embodiments of the invention can be implemented in hardware or in software or at least partially in hardware or at least partially in software. The implementation can be performed using a digital storage medium, for example a floppy disk, a DVD, a Blu-Ray, a CD, a ROM, a PROM, an EPROM, an EEPROM or a FLASH memory, having electronically readable control signals stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein. The data carrier, the digital storage medium or the recorded medium are typically tangible and/or non-transitory.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

A further embodiment according to the invention comprises an apparatus or a system configured to transfer (for example, electronically or optically) a computer program for performing one of the methods described herein to a receiver. The receiver may, for example, be a computer, a mobile device, a memory device or the like. The apparatus or system may, for example, comprise a file server for transferring the computer program to the receiver.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are preferably performed by any hardware apparatus.

The apparatus described herein may be implemented using a hardware apparatus, or using a computer, or using a combination of a hardware apparatus and a computer.

The methods described herein may be performed using a hardware apparatus, or using a computer, or using a combination of a hardware apparatus and a computer.

The above described embodiments are merely illustrative for the principles of the present invention. It is understood that modifications and variations of the arrangements and the details described herein will be apparent to others skilled in the art. It is the intent, therefore, to be limited only by the scope of the impending patent claims and not by the specific details presented by way of description and explanation of the embodiments herein.

REFERENCES

[1] T. Bäckström, Speech Coding with Code-Excited Linear Prediction. Springer, 2017.

[2] TS 26.445, EVS Codec Detailed Algorithmic Description; 3GPP Technical Specification (Release 12), 3GPP, 2014.

[3] ISO/IEC 23003-3:2012, "MPEG-D (MPEG audio technologies), Part 3: Unified speech and audio coding," 2012.

[4] B. Edler, "Coding of audio signals with overlapping block transform and adaptive window functions," Frequenz, vol. 43, no. 9, pp. 252-256, 1989.

[5] H. S. Malvar, Signal processing with lapped transforms. Artech House, Inc., 1992.

[6] T. Bäckström and C. R. Helmrich, "Arithmetic coding of speech and audio spectra using TCX based on linear predictive spectral envelopes," in Proc. ICASSP, April 2015, pp. 5127-5131.

[7] T. Bäckström, J. Fischer, and S. Das, "Dithered quantization for frequency-domain speech and audio coding," in Proc. Interspeech, 2018.

[8] T. Bäckström and J. Fischer, "Fast randomization for distributed low-bitrate coding of speech and audio," IEEE/ACM Trans. Audio, Speech, Lang. Process., vol. 26, no. 1, January 2018.

[9] T. Bäckström, F. Ghido, and J. Fischer, "Blind recovery of perceptual models in distributed speech and audio coding," in Proc. Interspeech, 2016, pp. 2483-2487.

[10] J.-M. Valin, G. Maxwell, T. B. Terriberry, and K. Vos, "High-quality, low-delay music coding in the OPUS codec," in Audio Engineering Society Convention 135. Audio Engineering Society, 2013.

[11] J. Vanderkooy and S. P. Lipshitz, "Dither in digital audio," Journal of the Audio Engineering Society, vol. 35, no. 12, pp. 966-975, 1987.

[12] F. C. Leone, L. S. Nelson, and R. B. Nottingham, "The folded normal distribution," Technometrics, vol. 3, no. 4, pp. 543-550, 1961.

The invention claimed is:

1. An apparatus for encoding an audio input signal to obtain an encoded audio signal, wherein the apparatus comprises:

a transformation module configured to transform the audio input signal from an original domain to a transform domain to obtain a transformed audio signal, and an encoding module, configured to quantize the transformed audio signal to obtain a quantized signal, and configured to encode the quantized signal to obtain the encoded audio signal, wherein the transformation module is configured to transform the audio input signal using a plurality of predefined power values of quantization noise in the original domain and using a plurality of predefined power values of the quantization noise in the transform domain for conducting transformation.

2. An apparatus according to claim 1, wherein the transformation module is configured to transform the audio input signal from the original domain to the transform domain by conducting an orthogonal transformation.

3. An apparatus according to claim 1, wherein the original domain is a spectral domain.

4. An apparatus according to claim 1, wherein the transformation module is configured to transform the audio input signal using a transformation matrix A, wherein the transformation module is configured to transform the audio input signal according to:

$$d=Ax,$$

wherein d indicates the transformed audio signal, wherein x indicates the audio input signal, wherein A indicates the transformation matrix depending on the plurality of predefined power values of the quantization noise in the original domain and depending on the plurality of predefined power values of the quantization noise in the transform domain.

5. An apparatus according to claim 4, wherein A is defined according to $$A=\begin{bmatrix} p & -\sqrt{1-p^2} \\ +\sqrt{1-p^2} & p \end{bmatrix},$$

wherein p is defined according to:

$$p=\pm\sqrt{\frac{d_0-c1}{c_0-c_1}},$$

wherein $$C_{ex}=\begin{bmatrix} d_0 & \cdot \\ \cdot & d_1 \end{bmatrix},$$

wherein $$C_{ed}=\begin{bmatrix} c_0 & 0 \\ 0 & c_1 \end{bmatrix},$$

wherein $C_{ex}$ is a first covariance matrix comprising on its diagonal the plurality of predefined power values of the quantization noise in the original domain, wherein $d_0$ and $d_1$ are matrix coefficients of $C_{ex}$, and wherein $C_{ed}$ is a second covariance matrix comprising on its diagonal the plurality of predefined power values of the quantization noise in the transform domain, wherein $c_0$ and $c_1$ are matrix coefficients of $C_{ed}$.

6. An apparatus according to claim 4, wherein the transform module is configured to determine the matrix A by determining two or more rotations depending on the plurality of predefined power values of quantization noise in the original domain and depending on the plurality of predefined power values of the quantization noise in the transform domain.

7. An apparatus according to claim 1, wherein the transformation module is configured to transform the audio input signal depending on a variance of the quantization noise in the transform domain.

8. An apparatus according to claim 7, wherein the variance $\sigma_q^2$ of the quantization noise in the transform domain is defined according to $$\sigma_q^2=\sigma_\xi^2\left(1-\frac{2}{\pi}\right),$$

wherein $\sigma_\xi^2$ is a variance of sign quantization of a sample $\xi$ of the transformed audio signal in the transform domain, wherein the transformation module is configured to transform the audio input signal depending on $C_{ed}$ that comprises on its diagonal the plurality of predefined power values of the quantization noise in the transform domain, wherein $C_{ed}$ is defined according to:

$$C_{ed} = \begin{bmatrix} \sigma_q^2 I_B & 0 \\ 0 & \sigma_\xi^2 I_{N-B} \end{bmatrix},$$

wherein N indicates a number of samples of the transformed audio signal, wherein B indicates a number of bits of the quantized signal, wherein $I_B$ indicates an identity matrix having B rows and B columns, and wherein $I_{N-B}$ indicates an identity matrix having NB rows and NB columns.

9. An apparatus according to claim 1, wherein the transformation module is configured to conduct permutations on samples of the audio input signal before transforming the audio input signal to the transform domain.

10. An apparatus for decoding an encoded audio signal to obtain a decoded audio signal, wherein the apparatus comprises:

a decoding module, configured to decode the encoded audio signal to obtain a quantized signal, and configured to dequantize the quantized signal to obtain an intermediate signal, being represented in a transform domain, and a transformation module configured to transform the intermediate signal from the transform domain to an original domain to obtain the decoded audio signal, wherein the transformation module is configured to transform the intermediate signal using a plurality of predefined power values of quantization noise in the original domain and using a plurality of predefined power values of the quantization noise in the transform domain for conducting transformation.

11. An apparatus according to claim 10, wherein the transformation module is configured to transform the intermediate signal from the transform domain to the original domain by conducting an orthogonal transformation.

12. An apparatus according to claim 10, wherein the original domain is a spectral domain.

13. An apparatus according to claim 10, wherein the transformation module is configured to transform the intermediate signal using a transformation matrix $A^T$, wherein the transformation module is configured to transform the audio input signal according to:

$$x = A^T d,$$

wherein d indicates the intermediate signal, wherein x indicates the decoded audio signal, wherein $A^T$ indicates the transformation matrix depending on the plurality of predefined power values of the quantization noise in the original domain and depending on the plurality of predefined power values of the quantization noise in the transform domain.

14. An apparatus according to claim 13, wherein $A^T$ is a conjugate transpose matrix of a matrix A, wherein the matrix A is defined according to:

$$A = \begin{bmatrix} p & -\sqrt{1-p^2} \\ +\sqrt{1-p^2} & p \end{bmatrix},$$

wherein p is defined according to:

$$p = \pm\sqrt{\frac{d_0 - c1}{c_0 - c_1}},$$

wherein $$C_{ex} = \begin{bmatrix} d_0 & \cdot \\ \cdot & d_1 \end{bmatrix},$$

wherein $$C_{ed} = \begin{bmatrix} c_0 & 0 \\ 0 & c_1 \end{bmatrix},$$

wherein $C_{ex}$ is a first covariance matrix comprising on its diagonal the plurality of predefined power values of the quantization noise in the original domain, wherein $d_0$ and $d_1$ are matrix coefficients of $C_{ex}$, and wherein $C_{ed}$ is a second covariance matrix comprising on its diagonal the plurality of predefined power values of the quantization noise in the transform domain, wherein $c_0$ and $c_1$ are matrix coefficients of $C_{ed}$.

15. An apparatus according to claim 13, wherein the transform module is configured to determine matrix $A^T$ by determining two or more rotations depending on the plurality of predefined power values of quantization noise in the original domain and depending on the plurality of predefined power values of the quantization noise in the transform domain.

16. An apparatus according to claim 10, wherein the transformation module is configured to transform the intermediate signal depending on a variance of the quantization noise in the transform domain.

17. An apparatus according to claim 16, wherein the variance $\sigma_q^2$ of the quantization noise in the transform domain is defined according to $$\sigma_q^2 = \sigma_\xi^2\left(1 - \frac{2}{\pi}\right),$$

wherein $\sigma_\xi^2$ is a variance of sign quantization of a sample $\xi$ of the quantized signal in the transform domain, wherein the transformation module is configured to transform the intermediate signal depending $C_{ed}$ that comprises on its diagonal the plurality of predefined power values of the quantization noise in the transform domain, wherein $C_{ed}$ is defined according to:

$$C_{ed} = \begin{bmatrix} \sigma_q^2 I_B & 0 \\ 0 & \sigma_\xi^2 I_{N-B} \end{bmatrix},$$

wherein N indicates a number of samples of the intermediate audio signal, wherein B indicates a number of bits of the quantized signal, wherein $I_B$ indicates an identity matrix having B rows and B columns, and wherein $I_{N-B}$ indicates an identity matrix having N-B rows and N-B columns.

18. An apparatus according to claim 10, wherein the transformation module is configured to conduct permutations on samples of the audio input signal after transforming the intermediate signal to the original domain to obtain the decoded audio signal.

19. An apparatus for decoding an encoded audio signal to obtain a decoded audio signal, wherein the apparatus comprises:

a decoding module, configured to decode the encoded audio signal to obtain a quantized signal, and configured to dequantize the quantized signal to obtain an intermediate signal, being represented in a transform domain, and a transformation module configured to transform the intermediate signal from the transform domain to an original domain to obtain the decoded audio signal, wherein the transformation module is configured to transform the intermediate signal using a plurality of predefined power values of quantization noise in the original domain and using a plurality of predefined power values of the quantization noise in the transform domain for conducting transformation, wherein the encoded audio signal is encoded by an apparatus according to claim 1.

20. A system comprising:

an apparatus for encoding an audio input signal to obtain an encoded audio signal, and an apparatus according to claim 10 for decoding the encoded audio signal to obtain a decoded audio signal, wherein the apparatus for encoding comprises:

a transformation module configured to transform the audio input signal from an original domain to a transform domain to obtain a transformed audio signal, and an encoding module, configured to quantize the transformed audio signal to obtain a quantized signal, and configured to encode the quantized signal to obtain the encoded audio signal, wherein the transformation module is configured to transform the audio input signal using a plurality of predefined power values of quantization noise in the original domain and using a plurality of predefined power values of the quantization noise in the transform domain for conducting transformation, wherein the apparatus according to claim 10 is configured to receive the encoded audio signal from the apparatus for encoding.

21. A method for encoding an audio input signal to obtain an encoded audio signal, wherein the method comprises:

transforming the audio input signal from an original domain to a transform domain to obtain a transformed audio signal, quantizing the transformed audio signal to obtain a quantized signal, and encoding the quantized signal to obtain the encoded audio signal, wherein transforming the audio input signal is conducted using a plurality of predefined power values of quantization noise in the original domain and using a plurality of predefined power values of the quantization noise in the transform domain.

22. A method for decoding an encoded audio signal to obtain a decoded audio signal, wherein the method comprises:

decoding the encoded audio signal to obtain a quantized signal, dequantizing the quantized signal to obtain an intermediate signal, being represented in a transform domain, and transforming the intermediate signal from the transform domain to an original domain to obtain the decoded audio signal, wherein transforming the intermediate signal is conducted using a plurality of predefined power values of quantization noise in the original domain and using a plurality of predefined power values of the quantization noise in the transform domain.

23. A non-transitory computer-readable medium comprising a computer program for implementing the method of claim 21 when being executed on a computer or signal processor.

24. A non-transitory computer-readable medium comprising a computer program for implementing the method of claim 22 when being executed on a computer or signal processor.

* * * * *